US008459950B2

(12) United States Patent
Shuto et al.

(10) Patent No.: US 8,459,950 B2
(45) Date of Patent: Jun. 11, 2013

(54) CONTRA-ROTATING PROPELLER UNIT, METHOD FOR ASSEMBLY THEREOF, METHOD FOR TRANSPORTATION THEREOF, AND METHOD FOR MOUNTING THEREOF ON MOTHER SHIP

(75) Inventors: Hideki Shuto, Tokyo (JP); Saiki Nishiyama, Tokyo (JP)

(73) Assignee: Japan Marine United Corporation, Tokyo (JP)

( * ) Notice: Subject to any disclaimer, the term of this patent is extended or adjusted under 35 U.S.C. 154(b) by 418 days.

(21) Appl. No.: 12/864,494

(22) PCT Filed: Nov. 28, 2008

(86) PCT No.: PCT/JP2008/071650

§ 371 (c)(1),
(2), (4) Date: Jul. 23, 2010

(87) PCT Pub. No.: WO2009/093379

PCT Pub. Date: Jul. 30, 2009

(65) Prior Publication Data

US 2010/0296929 A1 Nov. 25, 2010

(30) Foreign Application Priority Data

Jan. 23, 2008 (JP) ..... 2008-012713

(51) Int. Cl.
*B64C 11/48* (2006.01)
*B63H 5/10* (2006.01)

(52) U.S. Cl.
USPC ..... 416/129; 416/174

(58) Field of Classification Search
USPC ..... 416/174, 170 R, 128, 129, 146 A; 440/79–81, 83; 184/6.12; 29/889.6, 898.07
See application file for complete search history.

(56) References Cited

U.S. PATENT DOCUMENTS 3,396,800 A 8/1968 Hillander et al.
3,527,545 A 9/1970 Campbell et al.

(Continued)

FOREIGN PATENT DOCUMENTS

JP 54-87600 * 6/1979
JP 55-36020 * 3/1980

(Continued)

OTHER PUBLICATIONS

English translation of Office Action issued in related Korean application 10-2010-7013243 on Jun. 26, 2012.

(Continued)

*Primary Examiner* — Edward Look
*Assistant Examiner* — William Grigos
(74) *Attorney, Agent, or Firm* — Griffin & Szipl, P.C.

(57) ABSTRACT

The object is to facilitate the installation of a contra-rotating propeller on a mother ship. Disclosed is a contra-rotating propeller unit in which a predetermined part on the rear side of an inner shaft (12) is supported by a contra-rotating rear bearing (36) provided in a boss (13*a*) of a front propeller (13), and which includes an inner fixing tool (50) detachably attached to a tip of an outer shaft (11) to temporarily support a predetermined part on the front side of the inner shaft (12), and a contra-rotating thrust bearing (40) provided in the boss (13*a*) of the front propeller (13) to receive the thrust load from the outer shaft (11) to transmit the thrust load to the inner shaft (12).

20 Claims, 6 Drawing Sheets

U.S. PATENT DOCUMENTS

| | | | | |
|---|---|---|---|---|
| 4,642,059 | A * | 2/1987 | Nohara | 440/75 |
| 5,374,208 | A | 12/1994 | von Bergen et al. | |
| 5,795,200 | A | 8/1998 | Larkin | |
| 6,506,120 | B1 | 1/2003 | Lockwood | |
| 2008/0089786 | A1 | 4/2008 | Sinreich | |

FOREIGN PATENT DOCUMENTS

| | | | |
|---|---|---|---|
| JP | 60-18094 | | 2/1985 |
| JP | 60-18095 | | 2/1985 |
| JP | 61-52599 | | 4/1986 |
| JP | 61-94611 | | 6/1986 |
| JP | 61-99752 | | 6/1986 |
| JP | 62-181998 | | 8/1987 |
| JP | 63-66400 | | 5/1988 |
| JP | 1-87996 | | 6/1989 |
| JP | 1-237289 | A | 9/1989 |
| JP | 1-240399 | | 9/1989 |
| JP | 6-27519 | * | 7/1994 |
| JP | 6-27519 | Y2 | 7/1994 |
| JP | 7-10085 | | 1/1995 |
| JP | 7-33084 | A | 2/1995 |
| JP | 7-52881 | | 2/1995 |
| JP | 7-21437 | Y2 | 5/1995 |
| JP | 11-270571 | | 10/1999 |
| JP | 2005-67436 | A | 3/2005 |

OTHER PUBLICATIONS

Office Action issued in co-pending related U.S. Appl. No. 12/812,450 on Dec. 7, 2012.

International Search Report, issued in corresponding application PCT/JP2008/071650, completed Feb. 20, 2009, mailed Mar. 3, 2009.

International Search Report, issued in co-pending application of PCT/JP2008/071641, completed Feb. 23, 2009, mailed Mar. 3, 2009.

Office Action issued co-pending related U.S. Appl. No. 12/812,025 on Feb. 21, 2013.

* cited by examiner

CONTRA-ROTATING PROPELLER UNIT, METHOD FOR ASSEMBLY THEREOF, METHOD FOR TRANSPORTATION THEREOF, AND METHOD FOR MOUNTING THEREOF ON MOTHER SHIP

This is a National Phase Application in the United States of International Patent Application No. PCT/JP2008/071650 filed Nov. 28, 2008, which claims priority on Japanese Patent Application No. 2008-012713, filed Jan. 23, 2008. The entire disclosures of the above patent applications are hereby incorporated by reference.

BACKGROUND OF THE INVENTION

1. Technical Field of the Invention

The present invention relates to a contra-rotating propeller unit, a method for assembly thereof, a method for transportation thereof, and a method for mounting thereof on a mother ship.

2. Description of the Related Art

A contra-rotating propeller is a propeller system in which the rotational energy output from a front propeller is recovered by a rear propeller which rotates in a direction opposite to the front propeller and changed into a propulsive force so that high propeller efficiency is obtained. Hereinafter, a marine propulsion device mounted with a contra-rotating propeller is referred to as a "contra-rotating propeller marine propulsion device." The contra-rotating propeller marine propulsion device is disclosed in the following Patent Documents 1 and 2, for example.

As one of conventional examples of the contra-rotating propeller marine propulsion device, the "propulsion device of ship" disclosed in Patent Document 1 is shown in FIG. 1. In FIG. 1, a propulsion device 100 of a ship is adapted such that an inner shaft 102 and an outer shaft 101 are concentrically disposed, a rear propeller 104 is attached to the inner shaft 102, a front propeller 103 is attached to the outer shaft 101, the inner shaft 102 is rotationally driven by a main engine 105, such as a diesel engine, an electric motor or a gas turbine serving as a first driving unit, and the outer shaft 101 is rotationally driven by a main engine 106, such as a diesel engine, an electric motor or a gas turbine serving as a second driving unit. In addition, reference numeral 107 designates a driving shaft of the main engine 106, and reference numeral 108 designates a gear transmission unit.

Patent Document 1: Japanese Patent Application Laid-Open No. 2005-67436

Patent Document 2: Japanese Patent Application Laid-Open No. 7-33084

Conventionally, it is usual that the installation of the propulsion device to a mother ship is performed in a construction shipbuilding yard. However, a contra-rotating propeller has a complicated structure in respect of various points, such as a bearing structure, a lubrication structure, and a seal structure, compared to a uniaxial propeller in order to allow contra-rotating operation. For this reason, in a case where a contra-rotating propeller type propulsion device is installed in a mother ship, it is necessary to have full knowledge of the assembly know-how regarding the contra-rotating propeller in the construction shipbuilding yard, and the installation is difficult in a construction shipbuilding yard which is lacking in the assembly know-how regarding the contra-rotating propeller.

SUMMARY OF THE INVENTION

The invention was made in view of the above problems, and aims at providing a contra-rotating propeller unit, a method for assembly thereof, a method for transportation thereof, and a method for mounting thereof on a mother ship, capable of easily performing installation to a mother ship.

In order to solve the above problems, the contra-rotating propeller unit, method for assembly thereof, method for transportation thereof, and method for mounting thereof on a mother ship according to the invention adopt the following technical means.

(1) The invention is a contra-rotating propeller unit including a hollow outer shaft having a front propeller attached to a rear end thereof, and an inner shaft having a rear propeller attached to a rear end thereof and inserted into and supported in the outer shaft. A predetermined portion on the rear side of the inner shaft being supported by a contra-rotating rear bearing provided in a boss of the front propeller. The contra-rotating propeller unit includes an inner fixing tool which is detachably attached to a tip portion of the outer shaft to temporarily support a predetermined portion on the front side of the inner shaft, and a contra-rotating thrust bearing provided in the boss of the front propeller to receive the thrust load from the outer shaft to transmit the thrust load to the inner shaft.

According to the above construction of the contra-rotating propeller unit before attachment to a mother ship, as the stern side of the inner shaft is supported by the contra-rotating rear bearing, the bow side of the inner shaft is supported by the inner fixing tool, and the axial direction of the inner shaft with respect to the outer shaft is constrained by the contra-rotating thrust bearing, the contra-rotating propeller unit assembled in a transportable state is constructed. In a stage before the contra-rotating propeller unit is mounted on a mother ship, it is not possible to attach a contra-rotating front bearing for supporting the bow side of the inner shaft. Instead of this, however, the bow side of the inner shaft is supported by the inner fixing tool.

As a result, in the same way as assembling the contra-rotating propeller unit in advance in a specialized assembly factory, transporting a finished product to a construction shipbuilding yard, and inserting a uniaxial propeller in the construction shipbuilding yard, it is possible to insert the contra-rotating propeller unit into the stern tube of a mother ship, and it is possible to mount the contra-rotating propeller unit on a mother ship simply by a simple installation process. Accordingly, it is possible to easily perform installation to a mother ship, even in a construction shipbuilding yard which lacks in the assembly know-how regarding the contra-rotating propeller.

(2) In the contra-rotating propeller unit of the above (1), preferably, the inner fixing tool has a guide body with an external diameter which is equal to or greater than the external diameter of the outer shaft and is smaller than the internal diameter of stern tube bearing parts of a ship body mounted with the contra-rotating propeller unit, and the guide member is made of a material softer than the stern tube bearing part, and has a chamfered portion at the outer peripheral edge of the tip thereof.

Since the guide body of the inner fixing tool has the above construction, even if the outer shaft comes into contact with the stern tube bearing parts when the contra-rotating propeller unit is inserted into a stern tube of a mother ship in a construction shipbuilding yard, it is possible to prevent the outer shaft and the stern tube bearing parts from being damaged.

(3) The contra-rotating propeller unit of (1) or (2) preferably further includes an inner lifting tool detachably attached to a tip portion of the inner shaft and having a lifting piece provided at the tip thereof.

According to the above construction, it is possible to lift and move forward the inner lifting tool by proper lifting means, thereby smoothly inserting the contra-rotating propeller unit to a fixed position, if the inner shaft has projected towards an engine room from the stern tube when the contra-rotating propeller unit is inserted into the stern tube of a mother ship.

(4) In the contra-rotating propeller unit of the above (3), preferably, the inner shaft is formed in a hollow shape; lubricant oil passages of the same system are formed between the hollow portion of the inner shaft; the inner shaft and the outer shaft, a first seal member is provided between the inner fixing tool and the outer shaft, and a second seal member is provided between the inner fixing tool and the inner shaft; the third seal member is provided between the inner lifting tool and the inner shaft; and the inner lifting tool has an introduction oil passage for introducing lubricant oil into the hollow portion of the inner shaft.

According to the above construction, since the leakage of lubricant oil from between the outer shaft and the inner fixing tool, between the inner fixing tool and the inner shaft, and between the inner lifting tool and the inner shaft is prevented by the first to third seal members, it is possible to fill lubricant oil into a lubricant oil passage formed in the contra-rotating propeller unit to carry out proof-pressure confirmation, in advance in an assembly factory of the contra-rotating propeller unit.

(5) The contra-rotating propeller unit of the above (3) or (4), preferably, the contra-rotating propeller unit has a guide member with an external diameter which is greater than the external diameter of the tip portion of the inner shaft, and is smaller than the outer shaft, and the guide member is made of a material softer than the outer shaft, and has a chamfered portion at the outer peripheral edge of the tip thereof.

Since the guide body of the inner fixing tool has the above construction, even if the inner shaft comes into contact with the inner peripheral surface of the outer shaft when the inner shaft is inserted into the outer shaft in the assembly structure of the propeller unit, it is possible to prevent the outer shaft and the inner shaft from being damaged.

(6) In the contra-rotating propeller unit of any one of the above (1) to (5), preferably, the inner fixing tool has a construction capable of being radially split into a plurality of pieces.

According to the above construction, it is possible to attach the inner fixing tool to the tip portion of the outer shaft, without detaching the inner lifting tool from the inner shaft after the inner shaft is inserted into the outer shaft.

(7) The contra-rotating propeller unit of any one of the above (1) to (6) preferably further includes a stern tube rear seal unit installed in a predetermined part on the rear side of the outer shaft, and a rear seal fixing tool attached to the outer shaft to temporarily fix the stern tube rear seal unit to the outer shaft.

According to the above construction, by including the stern tube rear seal unit in the contra-rotating propeller unit, it is possible to further reduce installation work in a construction shipbuilding yard. Additionally, before being transported to a construction shipbuilding yard, there is no stern tube inner cylinder of a mother ship to which the stern tube rear seal unit should be inherently fixed. Instead of this, however, the outer shaft is temporarily fixed to the outer shaft by the rear seal fixing tool. As a result, it is possible to prevent the stern tube rear seal unit from being damaged due to the vibration during transportation.

(8) In the contra-rotating propeller unit of the above (7), preferably, the rear seal fixing tool has a construction capable of being radially split into a plurality of pieces.

According to the above construction, after the contra-rotating propeller unit is transported to a construction shipbuilding yard, and the outer shaft is inserted into the stern tube of a mother ship, it is possible to disassemble the rear seal fixing tool so as to be detached from the outer shaft, and it is possible to fix the stern tube rear seal unit to the rear end of the stern tube.

(9) The contra-rotating propeller unit of any one of the above (1) to (6) may further include a hollow stern tube inner cylinder which has stern tube bearing parts mounted thereon, has the outer shaft inserted thereinto, and supports the outer shaft, a stern tube rear seal unit attached to a rear end of the stern tube inner cylinder, and an outer fixing tool which is detachably attached to a tip portion of the stern tube inner cylinder, temporarily supports a predetermined part on the front side of the outer shaft, and temporarily constrains the axial movement of the outer shaft with respect to the stern tube inner cylinder.

(10) The invention is a method for assembling a contra-rotating propeller unit including a hollow outer shaft having a front propeller attached to a rear end thereof, and an inner shaft having a rear propeller attached to a rear end thereof and inserted into and supported in the outer shaft. The method includes the steps of: inserting the inner shaft into the outer shaft; assembling a contra-rotating thrust bearing for receiving the thrust load from the outer shaft to transmit the thrust load to the inner shaft, into a boss of the front propeller, thereby constraining the axial movement of the inner shaft with respect to the outer shaft; installing a contra-rotating rear bearing in the boss of the front propeller, and supporting a predetermined part on the rear side of the inner shaft by the contra-rotating rear bearing; and attaching an inner fixing tool to a tip portion of the outer shaft, and temporarily supporting a predetermined part on the front side of the inner shaft by the inner fixing tool.

(11) Additionally, another aspect of the invention is a method for assembling a contra-rotating propeller unit including a hollow outer shaft having a front propeller attached to a rear end thereof, and an inner shaft having a rear propeller attached to a rear end thereof and inserted into and supported in the outer shaft. The method includes the steps of: inserting the outer shaft into a hollow stern tube inner cylinder mounted with stern tube bearing parts; attaching a stern tube rear seal unit to a rear end of the stern tube inner cylinder; attaching an outer fixing tool to the stern tube inner cylinder, temporarily supporting a predetermined part on the front side of the outer shaft by the outer fixing tool, and temporarily constraining the axial movement of the outer shaft with respect to the stern tube inner cylinder; inserting the inner shaft into the outer shaft; assembling a contra-rotating thrust bearing for receiving the thrust load from the outer shaft to transmit the thrust load to the inner shaft, into a boss of the front propeller, thereby constraining the axial movement of the inner shaft with respect to the outer shaft; installing a contra-rotating rear bearing in the boss of the front propeller, and supporting a predetermined part on the rear side of the inner shaft by the contra-rotating rear bearing; and attaching an inner fixing tool to a tip portion of the outer shaft, and temporarily supporting a predetermined part on the front side of the inner shaft by the inner fixing tool.

According to the assembling method of the above (10) and (11), in the same way as assembling the contra-rotating propeller unit in advance in a specialized assembly factory, transporting a finished product to a construction shipbuilding yard, and inserting a uniaxial propeller in the construction shipbuilding yard, it is possible to insert the contra-rotating propeller unit into the stern tube inner cylinder or stern tube through hole of a mother ship, and it is possible to mount the contra-rotating propeller unit on a mother ship simply by a simple installation process. Accordingly, it is possible to easily perform installation to a mother ship, even in a construction shipbuilding yard which lacks in the assembly know-how regarding the contra-rotating propeller.

(12) The contra-rotating propeller unit (9) or (11) preferably further includes attaching an inner shaft lifting tool having a lifting piece provided at the tip thereof, to a tip portion of the inner shaft.

According to the above method, since the inner lifting tool is attaché to the tip portion of the inner shaft, it is possible to lift and move forward the inner lifting tool by proper lifting means, thereby smoothly inserting the contra-rotating propeller unit to a fixed position, if the inner shaft has projected towards an engine room from the stern tube when the contra-rotating propeller unit is inserted into the stern tube of a mother ship.

(13) The method for assembling a contra-rotating propeller unit of the above (10) preferably further includes installing a stern tube rear seal unit in a predetermined part on the rear side of the outer shaft, and attaching a rear seal fixing tool to the outer shaft to temporarily fix the stern tube rear seal unit to the outer shaft.

According to the above method, by including the stern tube rear seal unit in the contra-rotating propeller unit, it is possible to further reduce installation work in a construction shipbuilding yard. Additionally, before being transported to a construction shipbuilding yard, there is no stern tube inner cylinder of a mother ship to which the stern tube rear seal unit should be inherently fixed. Instead of this, however, the outer shaft is temporarily fixed to the outer shaft by the rear seal fixing tool. As a result, it is possible to prevent the stern tube rear seal unit from being damaged due to the vibration during transportation.

(14) In the method for assembling a contra-rotating propeller unit of the above (10), preferably, a contra-rotating propeller unit is assembled on a temporary placing base including an assembly lower base installed in an installation surface, and an upper receiving base detachably attached to the assembly lower base to support the outer shaft, and upper receiving bases with a plurality of kinds of sizes corresponding to the size of the outer shaft are allowed to be attached to the assembly lower base.

(15) In the method for assembling a contra-rotating propeller unit of the above (11), preferably, a contra-rotating propeller unit is assembled on a temporary placing base including an assembly lower base installed in an installation surface, and an upper receiving base detachably attached to the assembly lower base to support the stern tube inner cylinder, and upper receiving bases with a plurality of kinds of sizes corresponding to the size of the stern tube inner cylinder are allowed to be attached to the assembly lower base.

According to the method of the above (14) and (15), since the upper receiving base is attachable to the assembly lower base, and upper receiving bases of different sizes are attached to the assembly lower base, the upper receiving base is able to cope with differences in the size of the outer shaft or the stern tube inner cylinder, and is able to be commonly used for the assembly lower base.

(16) The invention is a method for transporting the contra-rotating propeller unit according to any one of the above (1) to (8) in which the contra-rotating propeller unit is assembled on the temporary placing base, and the contra-rotating propeller unit and the temporary placing base are placed on and transported by transportation means, with the assembled contra-rotating propeller unit placed on the temporary placing base.

(17) Additionally, the invention is a method for transporting the contra-rotating propeller unit according to the above (9) in which the contra-rotating propeller unit is assembled on the temporary placing base, and the contra-rotating propeller unit and the temporary placing base are placed on and transported by transportation means, with the assembled contra-rotating propeller unit placed on the temporary placing base.

According to the above method, since the contra-rotating propeller unit is assembled on the temporary placing base and is placed on transportation means in that state, it is not necessary to prepare a separate support base for being placed on the transportation means, and it is also possible to easily perform transfer to the transportation means.

(18) The invention is a method for mounting on a mother ship the contra-rotating propeller unit transported by the method for transporting the contra-rotating propeller unit of the above (16). The temporary placing base includes an assembly lower base installed in an installation surface, and an upper receiving base detachably attached to the assembly lower base to support the outer shaft. The fixation of the upper receiving base to the assembly lower base is released with the contra-rotating propeller unit supported by the upper receiving base, and the contra-rotating propeller unit is lifted parallel to the axial center of a stern tube by lifting the portion of the contra-rotating propeller unit behind a portion inserted into the stern tube of a mother ship, and the upper receiving base by the lifting means; and the lifted contra-rotating propeller unit is moved forward and inserted into the stern tube.

(19) The invention is a method for mounting on a mother ship the contra-rotating propeller unit transported by the method for transporting the contra-rotating propeller unit according to above (17). The temporary placing base includes an assembly lower base installed in an installation surface, and an upper receiving base detachably attached to the assembly lower base to support the outer shaft; the fixation of the upper receiving base to the assembly lower base is released with the contra-rotating propeller unit supported by the upper receiving base, and the contra-rotating propeller unit is lifted parallel to the axial center of a stern tube through hole by lifting the portion of the contra-rotating propeller unit behind the stern tube inner cylinder, and the upper receiving base by the lifting means; and the lifted contra-rotating propeller unit is moved forward and inserted into the stern tube through hole.

According to the method of the above (18) and (19), since the upper receiving base functions as a member for supporting the outer shaft when the contra-rotating propeller unit is separated and lifted from the assembly lower base, it is possible to lift the contra-rotating propeller unit, without attaching a separate supporting member to the outer shaft. As a result, it is possible to inset the contra-rotating propeller unit into the stern tube inner cylinder or the stern tube through hole, and attach the contra-rotating propeller unit to a mother ship in a short time.

According to the invention, it is possible to easily perform installation to a mother ship, even in a construction shipbuilding yard which lacks in the assembly know-how regarding the contra-rotating propeller.

DESCRIPTION OF THE PREFERRED EMBODIMENT

Figure 1:
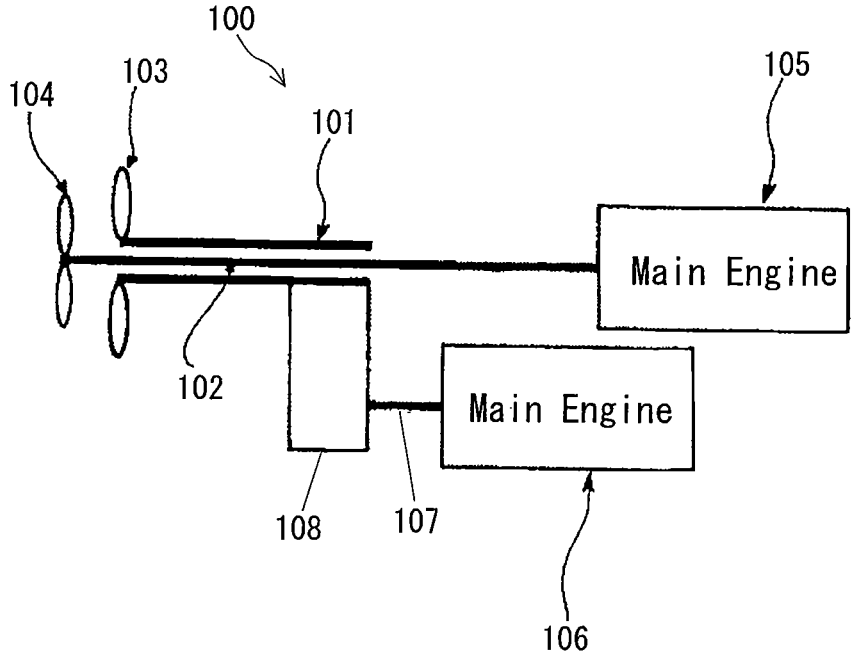
Fig. 1 Prior Art
FIG. 1 is a construction view of a prior art disclosed in Patent Document 1.

Preferred embodiments of the invention will now be described in detail with reference to the accompanying drawings. In addition, in the respective drawings, the same reference numerals will be given to common portions, and duplicate description thereof will be omitted.

Figure 2:
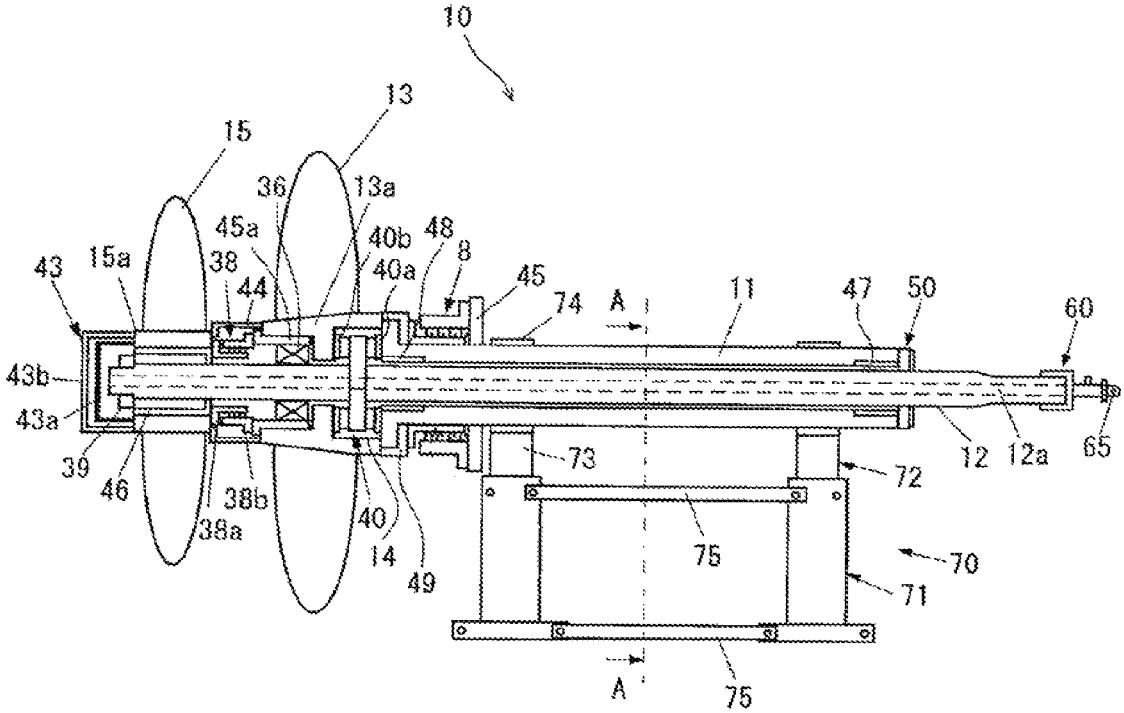
FIG. 2 is a construction view of a contra-rotating propeller unit according to a first embodiment of the invention.

FIG. 2 is a construction view of a contra-rotating propeller unit 10 according to a first embodiment of the invention. First, the construction of the contra-rotating propeller unit 10 will be described, and then a method for assembling the contra-rotating propeller unit 10 will be described.

In FIG. 2, the contra-rotating propeller unit 10 includes a hollow outer shaft 11 having a front propeller 13 to a rear end thereof, and an inner shaft 12 having a rear propeller 15 attached to a rear end thereof and supported in the outer shaft 11.

The front propeller 13 is attached to the rear end of the outer shaft 11. The front propeller 13 has a boss 13*a* at the central portion thereof, and a bow-side end face of the boss 13*a* and a stern-side end face of the outer shaft 11 are connected and fixed together by connecting means, such as a bolt. Axial guides 47 and 48 are provided on bow-side and stern-side inner end faces of the outer shaft 11 so that the inner shaft 12 is not damaged when being inserted into the outer shaft 11.

The inner shaft 12 has the rear propeller 15 attached to the rear end thereof, and is inserted into and supported by the outer shaft 11. In the present embodiment, the inner shaft 12 is formed in a hollow shape. In the contra-rotating propeller unit 10, lubricant oil passages of the same system are formed between a hollow portion 12*a* of the inner shaft 12, and the outer shaft 11 and the inner shaft 12. The rear propeller 15 has a boss 15*a* at the central portion thereof, is fitted into a rear end of the inner shaft 12 at the boss 15*a*, and is fixed to the inner shaft 12 by a propeller nut 39.

A predetermined part on the rear side of the inner shaft 12 is supported by a contra-rotating rear bearing 36 provided in the boss 13*a* of the front propeller 13. The contra-rotating rear bearing 36 is supported by a bearing housing 45*a* inserted and fixed from the rear side of the boss 13*a* of the front propeller 13, and is fixed to the inside of the boss 13*a*.

An inner fixing tool 50 for temporarily supporting a predetermined part on the front side of the inner shaft 12 is attached to a tip portion of the outer shaft 11. In a stage before the contra-rotating propeller unit 10 is mounted on a mother ship, it is not possible to attach a contra-rotating front bearing 35 (refer to FIG. 10) for supporting the bow side of the inner shaft 12. Thus, the bow side of the inner shaft 12 is temporarily supported (temporarily fixed) by the inner fixing tool 50 instead of the contra-rotating front bearing 35.

Figure 3:
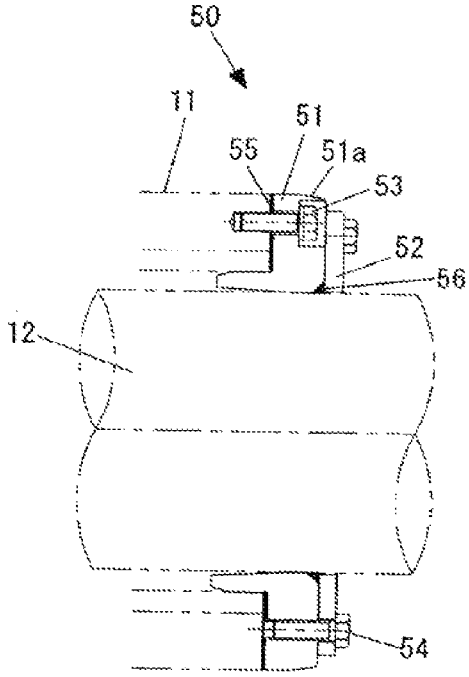
FIG. 3 is an enlarged structural view of an inner fixing tool in FIG. 2.

An enlarged structural view of the inner fixing tool 50 is shown in FIG. 3. As shown in FIG. 3, the inner fixing tool 50 has a guide body 51 with an external diameter which is equal to or greater than the external diameter of the outer shaft 11 and is smaller than the internal diameter of a front-side bush 5 and a rear-side bush 6 (refer to FIG. 7) that are stern tube bearing parts of a mother ship on which the contra-rotating propeller unit 10 is mounted. The guide body 51 is fixed to a bow-side end face of the outer shaft 11 by fixing means, such as a bolt 53.

The guide body 51 is made of a softer material (for example, copper) than the stern tube bearing parts, and has a chamfered portion 51*a* at the outer peripheral edge of the tip thereof. By this construction, even if the outer shaft 11 comes into contact with the stern tube bearing parts (the front-side bush 5 and rear-side bush 6) when the contra-rotating propeller unit 10 is inserted into a stern tube inner cylinder 3 of a mother ship in a construction shipbuilding yard, it is possible to prevent the outer shaft 11 and the stern tube bearing parts from being damaged.

The inner fixing tool 50 has a construction (two-split construction in this exemplary construction) capable of being radially split into a plurality of pieces. By this construction, in the assembly process of the contra-rotating propeller unit 10, it is possible to attach the inner fixing tool 50 to the tip portion of the outer shaft 11, without detaching the inner lifting tool 60 from the inner shaft 12 after the inner shaft 12 is inserted into the outer shaft 11.

Additionally, packing 55 serving as a first seal member is provided between the guide body 51 and the outer shaft 11, and an O ring 56 serving as a second seal member is provided between the guide body 51 and the inner shaft 12. Since the O ring 56 is fixed, a presser plate 52 is fixed to a bow-side end face of the guide body 51 by fixing means, such as a bolt 54. By this construction, since the leakage of lubricant oil from between the outer shaft 11 and the inner fixing tool 50 and between the inner fixing tool 50 and the inner shaft 12 is prevented by the first seal member and the second seal member, it is possible to fill lubricant oil into a lubricant oil passage formed between the outer shaft 11 and the inner shaft 12 to carry out proof-pressure confirmation, in advance in an assembly factory of the contra-rotating propeller unit 10.

Figure 4:
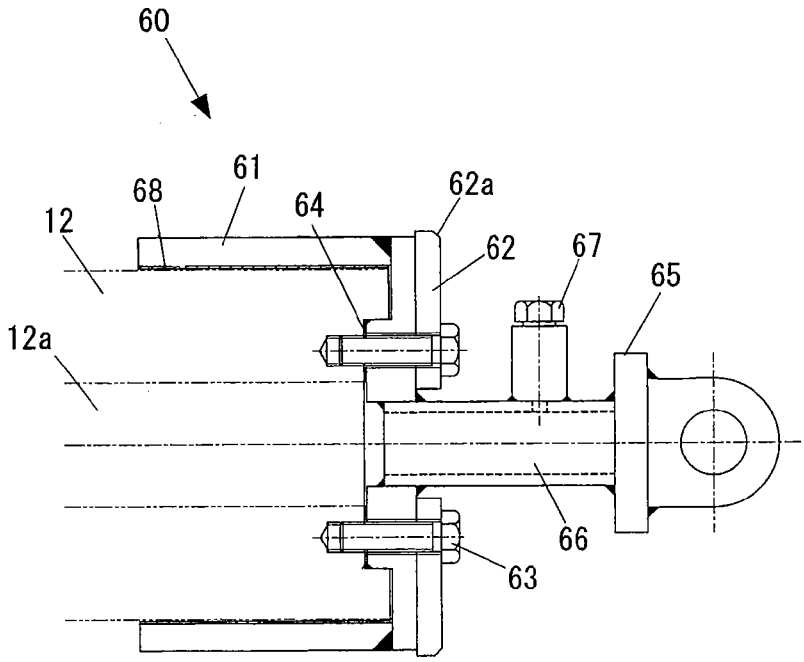
FIG. 4 is an enlarged structural view of an inner lifting tool in FIG. 2.

In FIG. 2, the inner lifting tool 60 which has a lifting piece 65 provided at the tip thereof is detachably attached to a tip portion of the inner shaft 12. An enlarged structural view of the inner lifting tool 60 is shown in FIG. 4. As shown in FIG. 4, the inner lifting tool 60 has a hollow cylindrical lifting body 61 which is formed so as to cover the tip portion of the inner shaft 12, and the lifting body 61 is fixed to the tip of the inner shaft 12 by fixing means, such as a bolt 63. A protective rubber sheet 68 is provided between the inner peripheral surface of the lifting body 61 and the outer peripheral surface of the inner shaft 12.

Additionally, the inner lifting tool 60 has a guide member 62 with an external diameter which is greater than the external diameter of the tip portion of the inner shaft 12, and is smaller than the internal diameter of the outer shaft 11. The guide member 62 is made of a softer material (for example, copper) than the outer shaft 11, and has a chamfered portion 62*a* at the outer peripheral edge of the tip thereof. By this construction, even if the inner shaft 12 comes into contact with the inner peripheral surface of the outer shaft 11 when the inner shaft 12 is inserted into the outer shaft 11 in the assembly process of the contra-rotating propeller unit 10, it is possible to prevent the outer shaft 11 and the inner shaft 12 from being damaged.

Additionally, packing 64 serving as a third seal member is provided between the lifting body 61 and the tip face of the inner shaft 12. The lifting piece 65 is provided with an introduction oil passage 66 for introducing the lubricant oil for proof-pressure confirmation into the hollow portion 12*a* of the inner shaft 12, and a connection seat 67 for connecting a lubricant oil supply pipe of a lubricant oil supply unit for proof-pressure confirmation which is not shown, and the inner fixing tool 50 is provided with an air bleeding plug (not shown) for performing air bleeding in an oil passage of lubricant oil for contra-rotating during filling of the lubricant oil. By this construction, it is possible to introduce the lubricant oil for proof-pressure confirmation into the hollow portion 12*a* of the inner shaft 12 from the lifting piece 65. Since the lubricant oil passages of the same system are formed between the hollow portion 12*a* of the inner shaft 12, and the outer shaft 11 and the inner shaft 12 as described above, it is possible to fill lubricant oil into between the outer shaft 11 and the inner shaft 12 by introducing the lubricant oil into the hollow portion 12*a*.

A contra-rotating thrust bearing 40 for receiving the thrust load of the outer shaft 11 to transmit the thrust load to the inner shaft 12 is disposed inside the boss of the front propeller 13. Specifically, an annular recess 14 is formed between the boss of the front propeller 13 and the outer shaft 11, and the contra-rotating thrust bearing 40 is provided in this annular recess 14. The contra-rotating thrust bearing 40 may be, for example, a tilting pad type thrust bearing.

An oil passage of lubricant oil is formed between the inner shaft 12 and the outer shaft 11. In order to prevent lubricant oil from leaking out from this oil passage and in order to prevent seawater from permeating into the oil passage, a contra-rotating rear seal unit 38 is arranged at a rear end of the boss 13*a* of the front propeller 13. The contra-rotating rear seal unit 38 includes a holler liner 38*a* fixed to a front end face of the rear propeller 15, and a seal ring 38*b* fixed to a rear end of the bearing housing 45*a*, and rotatably and slidably fitted into the liner 38*a*.

In this exemplary construction, a gap for forming a portion of an oil passage of lubricant oil is provided between the inner peripheral surface of the liner 38*a* and the outer peripheral surface of the inner shaft 12, and a rope guard 44 provided so as to cover the contra-rotating rear seal unit 38 is fixed to the rear end of the boss 13*a* of the front propeller 13.

In addition, a contra-rotating front seal unit 37 (refer to FIG. 10) is attached after the contra-rotating propeller unit 10 is inserted into the stern tube inner cylinder 3 of a mother ship.

A plurality of holes 46 which passes through the boss 15*a* of the rear propeller 15 in a front-back direction is provided in the peripheral direction. This hole 46 forms a portion of an oil passage of lubricant oil. A propeller cap 43 for preventing the leakage of lubricant oil is attached to the rear end of the boss 15*a* of the rear propeller 15. The propeller cap 43 has a dual structure which has an inside cap 43*a* and an outside cap 43*b* for the improvement in reliability. Both a rear end of the hole 46 of the boss 15*a* of the rear propeller 15 and a rear end of the hollow portion 12*a* of the inner shaft 12 are opened so as to face the inside of the propeller cap 43 (the inside cap 43*a*).

In the proof-pressure confirmation of the contra-rotating propeller unit 10 constructed as described above, the lubricant oil introduced into the hollow portion 12*a* of the inner shaft 12 via the lifting piece 65 of the inner lifting tool 60 permeates into the propeller cap 43 from the rear end of the inner shaft 12, passes through the hole 46 formed in the boss of the rear propeller 15 and the gap formed between the inner shaft 12 and the contra-rotating rear seal unit 38, and reaches the tip of the outer shaft 11 through the contra-rotating rear bearing 36 and the contra-rotating thrust bearing 40. As a result, the lubricant oil for proof-pressure confirmation is filled into between the outer shaft 11 and the inner shaft 12.

In addition, the flow direction of the lubricant oil supplied to contra-rotating parts when the contra-rotating propeller unit 10 is mounted on a mother ship, and operates as a contra-rotating propeller propulsion device may be a direction opposite to the flow direction of lubricant oil at proof-pressure confirmation. That is, after lubricant oil is introduced from between the contra-rotating front bearing 35 and the contra-rotating front seal unit 37 (refer to FIG. 10) to lubricate the contra-rotating front bearing 35, the contra-rotating thrust bearing 40, and the contra-rotating rear bearing 36, the lubricant oil may enter the hollow portion 12*a* of the inner shaft 12 via the propeller cap 43. In this case, in FIG. 10, the lubricant oil from the inner shaft 12 is discharged from a tip portion through a hollow portion of an inner output shaft 29, and is returned to a lubricant oil tank which is not shown.

A stern tube rear seal unit 8 for preventing the leakage the lubricant oil in the stern tube inner cylinder 3 (refer to FIG. 10) towards the seawater is attached to the rear side of the outer shaft 11. Additionally, in FIG. 2, a rear seal fixing tool 45 for temporarily fixing the stern tube rear seal unit 8 to the outer shaft 11 is attached to the outer shaft 11. Before being transported to a construction shipbuilding yard, there is no stern tube inner cylinder 3 of a mother ship to which the stern tube rear seal unit 8 should be inherently fixed. Thus, instead of the stern tube inner cylinder 3, the stern tube rear seal unit 8 is temporarily fixed to the outer shaft 11 by the rear seal fixing tool 45.

Additionally, the rear seal fixing tool 45 has a construction (two-split construction in this exemplary construction) capable of being radially split into a plurality of pieces. By this construction, after transportation to a construction shipbuilding yard is made, and the outer shaft 11 is inserted into the stern tube inner cylinder 3 of a mother ship, it is possible to disassemble the rear seal fixing tool 45 so as to be detached from the outer shaft 11, and it is possible to fix the stern tube rear seal unit 8 to the rear end of the stern tube inner cylinder 3 (refer to FIG. 10).

Next, a method for assembling the contra-rotating propeller unit 10 including the above construction will be described.

The assembly work of the contra-rotating propeller unit 10 is performed on a temporary placing base 70. The temporary placing base 70 includes an assembly lower base 71 installed in an installation surface, and an upper receiving base 72 detachably attached to the assembly lower base 71 to support the outer shaft 11. In the exemplary construction of FIG. 2, two assembly lower bases 71 are arranged at the front and rear, and are mutually connected together at four points including upper, lower, right, and left by connecting reinforcing members 75.

Figure 5:
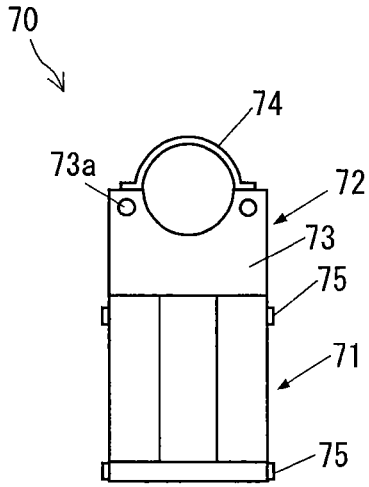
FIG. 5 is a sectional view taken along a line A-A in FIG. 2.

A sectional view taken along a line A-A in FIG. 2 is shown in FIG. 5. It is noted herein that, in FIG. 5, illustration of the outer shaft 11 and the inner shaft 12 is omitted.

As shown in FIG. 5, the upper receiving base 72 has a receiving base body 73, and an upper cover 74 fixed to an upper portion of the receiving base body 73 by fixing means, such as a bolt, and the outer shaft 11 is supported by the receiving base body 73 and the upper cover 74 while being sandwiched therebetween.

Additionally, holes 73*a* for allowing wire ropes 77 (refer to FIG. 6) of lifting means to be used when the contra-rotating propeller unit 10 is lifted to pass therethrough are provided on both the right and left sides of the receiving base body 73.

In the temporary placing base 70, it is possible to attach upper receiving bases 72 with a plurality of kinds of sizes corresponding to the size of the outer shaft 11 to the assembly lower base 71. By this construction, the upper receiving base 72 is able to cope with differences in the size of the outer shaft 11, and is able to be used commonly to the assembly lower base 71.

With reference to FIG. 2, the assembly work of the contra-rotating propeller unit 10 is performed according to the following procedure.

(1) A flange cover 49 is inserted and temporarily placed to a flange end face formed at the rear end of the outer shaft 11, from the bow side of the outer shaft 11. Next, the stern tube rear seal unit 8 is inserted into the outer shaft 11, and is temporarily fixed at a predetermined position by the rear seal fixing tool 45. Then, the outer shaft 11 in this state is placed on the receiving base body 73 of the upper receiving base 72, and the upper cover 74 is attached and fixed to the receiving base body 73 by fixing means, such as a bolt.

(2) A bow-side pad 40*a* of the contra-rotating thrust bearing 40 is attached to a stern end face of the outer shaft 11, the inner lifting tool 60 is attached and fixed to the tip portion of the inner shaft 12, the inner shaft 12 is inserted to a predetermined position from the stern side of the outer shaft 11, and the inner fixing tool 50 is attached to the tip portion of the outer shaft 11, thereby temporarily supporting the bow side of the inner shaft 12. When the inner shaft 12 is inserted into the outer shaft 11, any damage resulting from the contact the inner shaft 12 with the outer shaft 11 is prevented because the axial guides 47 and 48 are provided on the bow-side and stern-side inner end faces of the outer shaft 11 as described above.

(3) After the stern-side pad 40*b* of the contra-rotating thrust bearing 40 is attached to a bow-side end face inside the boss 13*a* of the front propeller 13, the contra-rotating rear bearing 36 is attached to the stern-side inside of the boss 13*a*, the front propeller 13 is arranged on a flange rear end face of the outer shaft 11, and is fixed by fixing means, such as a bolt. Next, the flange cover 49 is fixed to a flange of the outer shaft 11 by fixing means, such as a bolt.

(4) The contra-rotating rear seal unit 38 is attached to a rear end face of the bearing housing 45*a*, and the rope guards 44 are fixed to a rear end face of the boss 13*a* of the front propeller 13 by fixing means, such as a bolt.

(5) As the rear propeller 15 is pushed into and thereby attached to the inner shaft 12 by using a hydraulic system, and is fixed thereto with the propeller nut 39, and then the propeller cap 43 is attached to a rear end of the rear propeller 15.

According to the contra-rotating propeller unit 10 and method for assembly thereof described above, the following effects are obtained.

As the stern side of the inner shaft 12 is supported by the contra-rotating rear bearing 36, the bow side of the inner shaft 12 is supported by the inner fixing tool 50, and the axial direction of the inner shaft 12 with respect to the outer shaft 11 is constrained by the contra-rotating thrust bearing 40, the contra-rotating propeller unit 10 assembled in a transportable state is constructed. As a result, in the same way as assembling the contra-rotating propeller unit 10 in advance in a specialized assembly factory, transporting a finished product to a construction shipbuilding yard, and inserting a uniaxial propeller in the construction shipbuilding yard, it is possible to insert the contra-rotating propeller unit 10 into the stern tube inner cylinder 3 of a mother ship, and it is possible to mount the contra-rotating propeller unit 10 on a mother ship simply by a simple installation process. Accordingly, it is possible to easily perform installation to a mother ship, even in a construction shipbuilding yard which lacks in the assembly know-how regarding the contra-rotating propeller.

Figure 7:
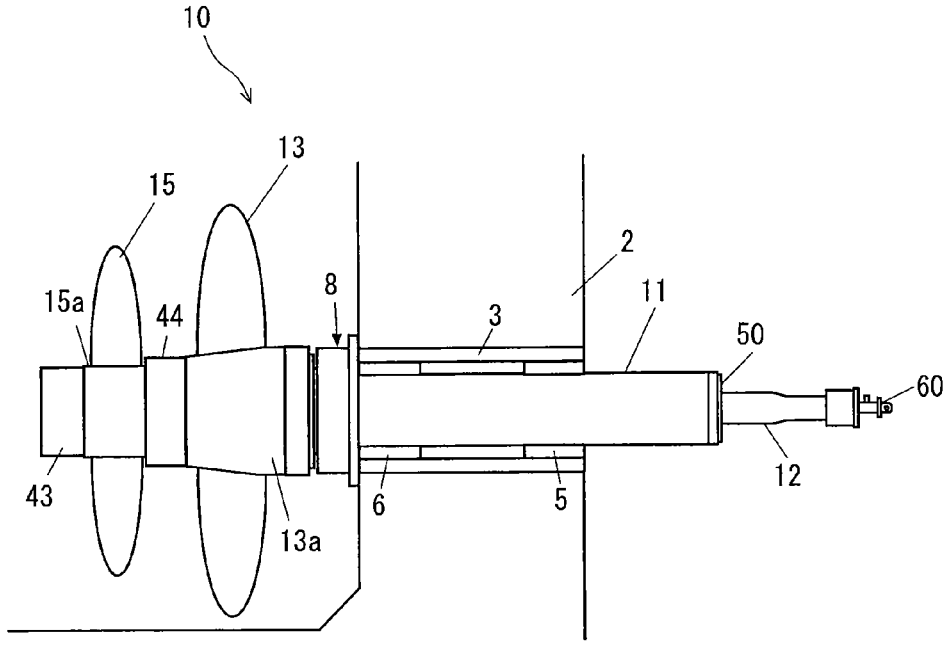
FIG. 7 is a second explanatory view of the method for mounting the contra-rotating propeller unit according to the first embodiment on a mother ship.

Since the inner lifting tool 60 is provided, it is possible to lift and move forward the inner lifting tool 60 by proper lifting means, thereby smoothly inserting the contra-rotating propeller unit 10 to a fixed position, if the inner shaft 12 has projected towards an engine room from the stern tube inner cylinder 3 when the contra-rotating propeller unit 10 is inserted into the stern tube inner cylinder 3 of a mother ship (refer to FIG. 7).

By including the stern tube rear seal unit 8 in the contra-rotating propeller unit 10, it is possible to further reduce installation work in a construction shipbuilding yard. Additionally, instead of the stern tube inner cylinder 3, the stern tube rear seal unit 8 is temporarily fixed to the outer shaft 11 by the rear seal fixing tool 45. Thus, additionally, since temporarily fixing of the stern tube rear seal unit 8 is carried out to the outer shaft 11 with the rear seal fixing tool 45 instead of the stern tube inner cylinder 3, it is possible to prevent the stern tube rear seal unit 8 from being damaged due to the vibration during transportation.

Figure 6:
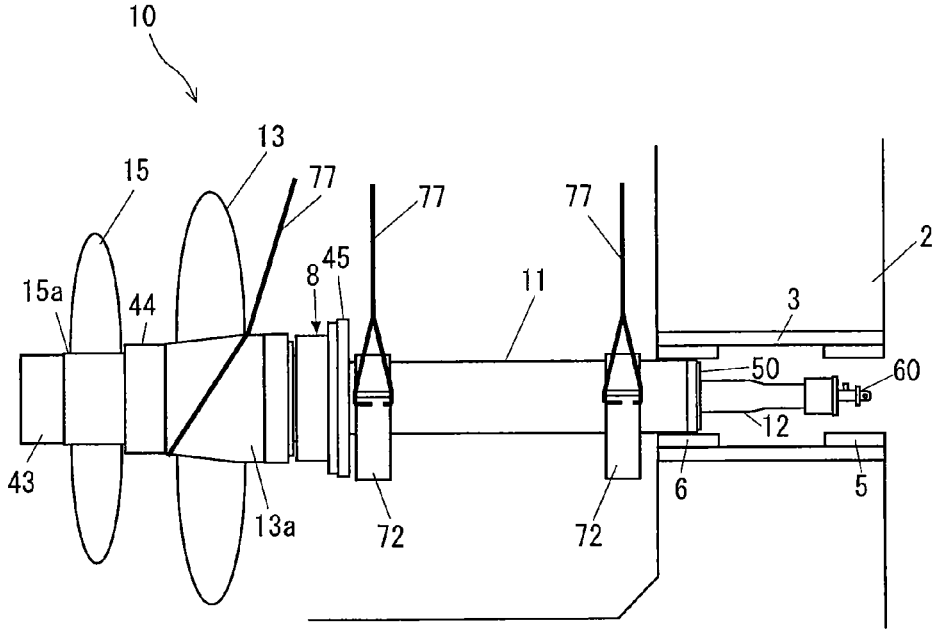
FIG. 6 is a first explanatory view of a method for mounting the contra-rotating propeller unit according on the first embodiment on a mother ship.

Since the inner fixing tool 50 has the guide body 51 with an external diameter which is equal to or greater than the external diameter of the outer shaft 11 and is smaller than the internal diameter of the stern tube bearing parts (the front-side bush 5 and a rear-side bush 6) of a mother ship on which the contra-rotating propeller unit 10 is mounted, and the guide body 51 is made of a material softer than the stern tube bearing parts, and has the chamfered portion 51*a* at the outer peripheral edge of the tip thereof, even if the outer shaft 11 comes into contact with the stern tube bearing parts when the contra-rotating propeller unit 10 is inserted into the stern tube inner cylinder 3 of a mother ship in a construction shipbuilding yard, it is possible to prevent the outer shaft 11 and the stern tube bearing parts from being damaged (refer to FIG. 6).

Since the inner lifting tool 60 has the guide member 62 with an external diameter which is greater than the external diameter of the tip portion of the inner shaft 12, and is smaller than the outer shaft 11, and the guide member 62 is made of a material softer than the outer shaft 11, and has a chamfered portion 62*a* at the outer peripheral edge of the tip thereof, even if the inner shaft 12 comes into contact with the inner peripheral surface of the outer shaft 11 when the inner shaft 12 is inserted into the outer shaft 11 in the assembly process of the contra-rotating propeller unit 10, it is possible to prevent the outer shaft 11 and the inner shaft 12 from being damaged.

Since the leakage of lubricant oil from between the outer shaft 11 and the inner fixing tool 50, between the inner fixing tool 50 and the inner shaft 12, and between the inner lifting tool 60 and the inner shaft 12 is prevented by the first to third seal members 55, 56, and 64, it is possible to fill lubricant oil into a lubricant oil passage formed in the contra-rotating propeller unit 10 to carry out proof-pressure confirmation, in advance in an assembly factory of the contra-rotating propeller unit 10.

Since the inner fixing tool 50 has a construction capable of being radially split into a plurality of pieces, it is possible to attach the inner fixing tool 50 to the tip portion of the outer shaft 11, without detaching the inner lifting tool 60 from the inner shaft 12 after the inner shaft 12 is inserted into the outer shaft 11.

Since the rear seal fixing tool 45 has a construction capable of being radially split into a plurality of pieces, after transportation to a construction shipbuilding yard is made, and the outer shaft 11 is inserted into the stern tube inner cylinder 3 of a mother ship, it is possible to disassemble the rear seal fixing tool 45 so as to be detached from the outer shaft 11, and it is possible to fix the stern tube rear seal unit 8 to the rear end of the stern tube inner cylinder 3.

Next, a method for transporting the contra-rotating propeller unit 10 will be described.

The method for transporting the contra-rotating propeller unit 10 of the invention includes assembling the contra-rotating propeller unit 10 on the temporary placing base 70, and placing and transporting the contra-rotating propeller unit 10 and the temporary placing base 70 on transportation means (truck, etc.), with the assembled contra-rotating propeller unit 10 placed on the temporary placing base 70.

According to the above method, since the contra-rotating propeller unit 10 is assembled on the temporary placing base 70 and is placed on transportation means in that state, it is not necessary to prepare a separate support base for being placed on the transportation means, and it is also possible to easily perform transfer to the transportation means.

Next, a method for mounting the contra-rotating propeller unit 10 on a mother ship will be described with reference to FIGS. 6 and 7.

If the contra-rotating propeller unit 10 in the state of being placed on the temporary placing base 70 has been transported to a construction shipbuilding yard by transportation means, this is put on a predetermined position behind the stern tube inner cylinder 3 of a mother ship. Then, the fixation of the upper receiving base 72 to the assembly lower base 71 is released with the contra-rotating propeller unit 10 supported by the upper receiving base 72. Next, the contra-rotating propeller unit 10 is lifted parallel to the axial center of the stern tube inner cylinder 3 by lifting the portion of the contra-rotating propeller unit 10 behind a portion inserted into the stern tube inner cylinder 3 of a mother ship, and the upper receiving base 72 by the lifting means. Here, the wire ropes 77 of the lifting means are shown in FIG. 6, and perform lifting at a total of three points including two upper receiving bases 72 and front propellers 13.

In addition, if possible, the contra-rotating propeller unit 10 may be lifted at two points. Additionally, if possible, the rear propeller 15 instead of the front propeller 13 may be used as one of lifting points.

Next, the lifted contra-rotating propeller unit 10 is moved forward, and is inserted into the stern tube inner cylinder 3. As described above, since the inner fixing tool 50 has the guide body 51 with an external diameter which is equal to or greater than the external diameter of the outer shaft 11 and is smaller than the internal diameter of the stern tube bearing parts (the front-side bush 5 and a rear-side bush 6) of a mother ship on which the contra-rotating propeller unit 10 is mounted, and the guide body 51 is made of a material softer than the stern tube bearing parts, and has the chamfered portion 51*a* at the outer peripheral edge of the tip thereof (refer to FIG. 3), even if the outer shaft 11 comes into contact with the stern tube bearing parts when the contra-rotating propeller unit 10 is inserted into the stern tube inner cylinder 3 of a mother ship in a construction shipbuilding yard, it is possible to prevent the outer shaft 11 and the stern tube bearing parts from being damaged.

With an increase in the amount of insertion the contra-rotating propeller unit 10 into the stern tube inner cylinder 3, as needed when the point lifted by the upper receiving base 72 becomes close to a rear portion of the stern tube inner cylinder 3, the support point of the outer shaft 11 by the upper receiving base 72 is shifted backward, or the upper receiving base 72 is detached from the outer shaft 11. If the inner shaft 12 has projected towards the engine room from the stern tube inner cylinder 3, in the engine room, the inner lifting tool 60 is lifted and moved forward by proper lifting means and as shown in FIG. 7, is inserted into a fixed position of the contra-rotating propeller unit 10.

According to the above mounting method, since the upper receiving base 72 functions as a member for supporting the outer shaft 11 when the contra-rotating propeller unit 10 is separated and lifted from the assembly lower base 71, it is possible to lift the contra-rotating propeller unit 10 to insert the propeller unit into the stern tube inner cylinder 3, without attaching a separate supporting member to the outer shaft 11. Accordingly, it is possible to attach the contra-rotating propeller unit 10 to a mother ship in a short time.

Additionally, since the rear seal fixing tool 45 has a construction capable of being radially split into a plurality of pieces, after transportation to a construction shipbuilding yard is made, and the outer shaft 11 is inserted into the stern tube inner cylinder 3 of a mother ship, it is possible to disassemble the rear seal fixing tool 45 so as to be detached from the outer shaft 11, and it is possible to fix the stern tube rear seal unit 8 to the rear end of the stern tube inner cylinder 3.

Next, a contra-rotating propeller unit 10' according to a second embodiment of the invention will be described with reference to FIG. 8.

The contra-rotating propeller unit 10' of the present embodiment includes a hollow stern tube inner cylinder 3 which has stern tube bearing parts (the front-side bush 5 and the rear-side bush 6) mounted thereon, has the outer shaft 11 inserted thereinto, and supports the outer shaft 11, the stern tube rear seal unit 8 attached to the rear end of the stern tube inner cylinder 3, and an outer fixing tool 69 which is detachably attached to the tip portion of the stern tube inner cylinder 3, temporarily supports a predetermined part on the front side of the outer shaft 11, and temporarily constrains the axial movement of the outer shaft 11 with respect to the stern tube inner cylinder 3.

The inner fixing tool 69 is a ring-shaped member with an external diameter smaller than the internal diameter of a stern tube through hole 1 (refer to FIG. 9), and has a construction (two-split construction in this exemplary construction) capable of being radially split into a plurality of pieces.

In the contra-rotating propeller unit of the first embodiment described above, the stern tube inner cylinder 3 is not included in a unit assembly stage. However, in the contra-rotating propeller unit 10' of the present embodiment, the stern tube inner cylinder 3 is included in the unit assembly stage. The present embodiment is different from the first embodiment in this regard. For this reason, unlike the first embodiment, the rear seal fixing tool 45 is not provided in the contra-rotating propeller unit 10' of the second embodiment. Since other constructions are the same as those of the first embodiment, description thereof will be omitted.

The assembly work of the contra-rotating propeller unit 10' having the above construction is performed on a temporary placing base 70. The temporary placing base 70 has the same construction as the temporary placing base 70 shown in FIGS. 2 and 5 except for the point that the upper receiving base 72 supports the stern tube inner cylinder 3 instead of the outer shaft 11.

Figure 8:
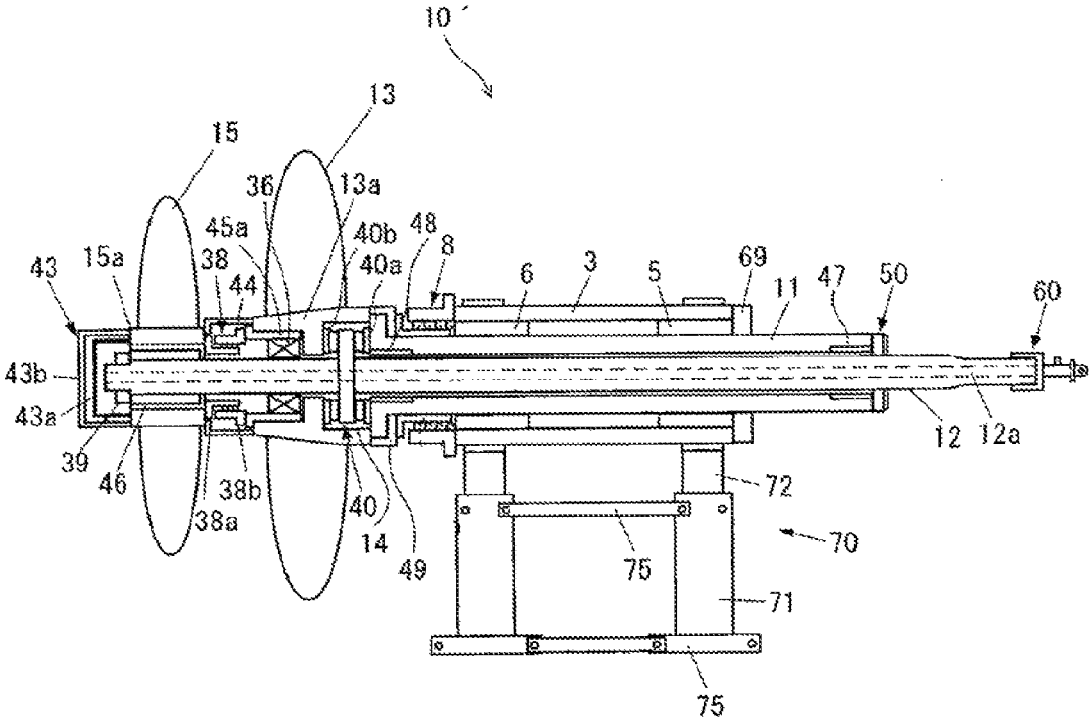
FIG. 8 is a construction view of a contra-rotating propeller unit according to a second embodiment of the invention.

With reference to FIG. 8, the assembly work of the contra-rotating propeller unit 10' is performed according to the following procedure.

(1) The front-side bush 5 and the rear-side bush 6 are respectively press-fitted into a front portion and a rear portion of the stern tube inner cylinder 3.

(2) A flange cover 49 is inserted and temporarily placed to a flange end face formed at the rear end of the outer shaft 11, from the bow side of the outer shaft 11. Next, after the stern tube rear seal unit 8 is inserted into the outer shaft 11, the outer shaft is inserted into the stern tube inner cylinder mounted with the front-side bush 5 and the rear-side bush 6 to a given position, and the stern tube rear seal unit 8 is fixed to the rear end of the stern tube inner cylinder 3.

(3) The outer fixing tool 69 is attached to a tip portion of the stern tube inner cylinder 3 by fixing means, such as a bolt, a predetermined part on the front side of the outer shaft 11 is temporarily supported, and the axial movement of the outer shaft 11 with respect to the stern tube inner cylinder 3 is temporarily constrained.

(4) One which is assembled to the state of the above (3) is placed on the receiving base body 73 of the upper receiving base 72, and the upper cover 74 is attached and fixed to the receiving base body 73 by fixing means, such as a bolt. Since the subsequent assembly procedure is the same as those of (2) to (5) of the assembly procedure of the contra-rotating propeller unit 10 of the first embodiment, description thereof will be omitted.

According to the contra-rotating propeller unit 10' and method for assembly thereof of the present embodiment, similarly to the first embodiment, it is possible to assemble the contra-rotating propeller unit 10' in advance in a special assembly factory, transport a finished product to a construction shipbuilding yard, and perform installation to a mother ship in a construction shipbuilding yard. Accordingly, it is possible to easily perform installation to a mother ship, even in a construction shipbuilding yard which lacks in the assembly know-how regarding the contra-rotating propeller.

The method for transporting the contra-rotating propeller unit 10' according to the second embodiment of the invention, similarly to the first embodiment, includes assembling the contra-rotating propeller unit 10' on the temporary placing base 70, and placing and transporting the contra-rotating propeller unit 10 and the temporary placing base 70 by and on transportation means (truck, etc.), with the assembled contra-rotating propeller unit 10' placed on the temporary placing base 70. According to this transporting method, similarly to the transporting method of the first embodiment, it is not necessary to prepare a separate support base for being placed on the transportation means, and it is also possible to easily perform transfer to the transportation means.

Figure 9:
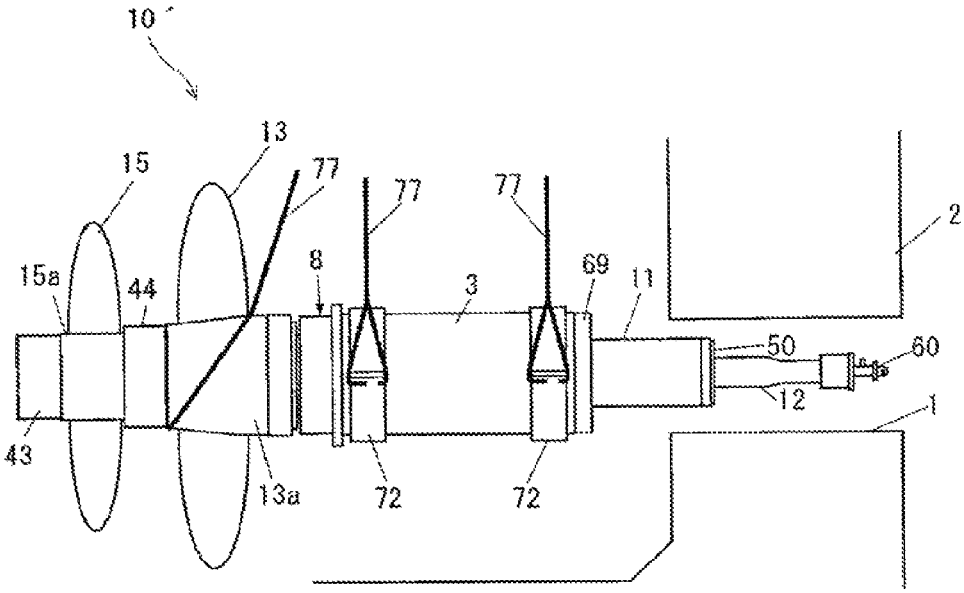
FIG. 9 is an explanatory view of a method for mounting the contra-rotating propeller unit according on the second embodiment to a mother ship.

Next, the method for mounting the contra-rotating propeller unit 10' according to the second embodiment on a mother ship will be described with reference to FIG. 9.

If the contra-rotating propeller unit 10 in the state of being placed on the temporary placing base 70 has been transported to a construction shipbuilding yard by transportation means, this is put on a predetermined position behind the stern tube inner cylinder 3 of a mother ship. Then, the fixation of the upper receiving base 72 to the assembly lower base 71 is released with the contra-rotating propeller unit 10 supported by the upper receiving base 72. Next, the contra-rotating propeller unit 10' is lifted parallel to the axial center of the stern tube through hole 1 by lifting the portion of the contra-rotating propeller unit 10 behind the stern tube inner cylinder 3, and the upper receiving base 72 by the lifting means. Here, the wire ropes 77 of the lifting means are shown in FIG. 9, and perform lifting at a total of three points including two upper receiving bases 72 and front propellers 13.

In addition, if possible, the contra-rotating propeller unit 10' may be lifted at two points. Additionally, if possible, the rear propeller 15 instead of the front propeller 13 may be used as one of lifting points.

Next, the lifted contra-rotating propeller unit 10' is moved forward, and is inserted into the stern tube through hole 1. With an increase in the amount of insertion the contra-rotating propeller unit 10' into the stern tube through hole 1, as needed when the point lifted by the upper receiving base 72 becomes close to a rear portion of the stern tube through hole 1, the support point of the stern tube inner cylinder 3 by the upper receiving base 72 is shifted backward, or the upper receiving base 72 is detached from the stern tube inner cylinder 3. If the inner shaft 12 has projected towards the engine room from the stern tube through hole 1, in the engine room, the inner lifting tool 60 is lifted and moved forward by proper lifting means, is inserted into a fixed position of the contra-rotating propeller unit 10', and is brought into the same state as that shown in FIG. 7.

According to the mounting method of the second embodiment described above, since the upper receiving base 72 functions as a member for supporting the stern tube inner cylinder 3 when the contra-rotating propeller unit 10' is separated and lifted from the assembly lower base 71, it is possible to lift the contra-rotating propeller unit 10' to insert the propeller unit into the stern tube inner cylinder 3, without attaching a separate supporting member to the stern tube inner cylinder 3. Accordingly, it is possible to attach the contra-rotating propeller unit 10' to a mother ship in a short time.

Figure 10:
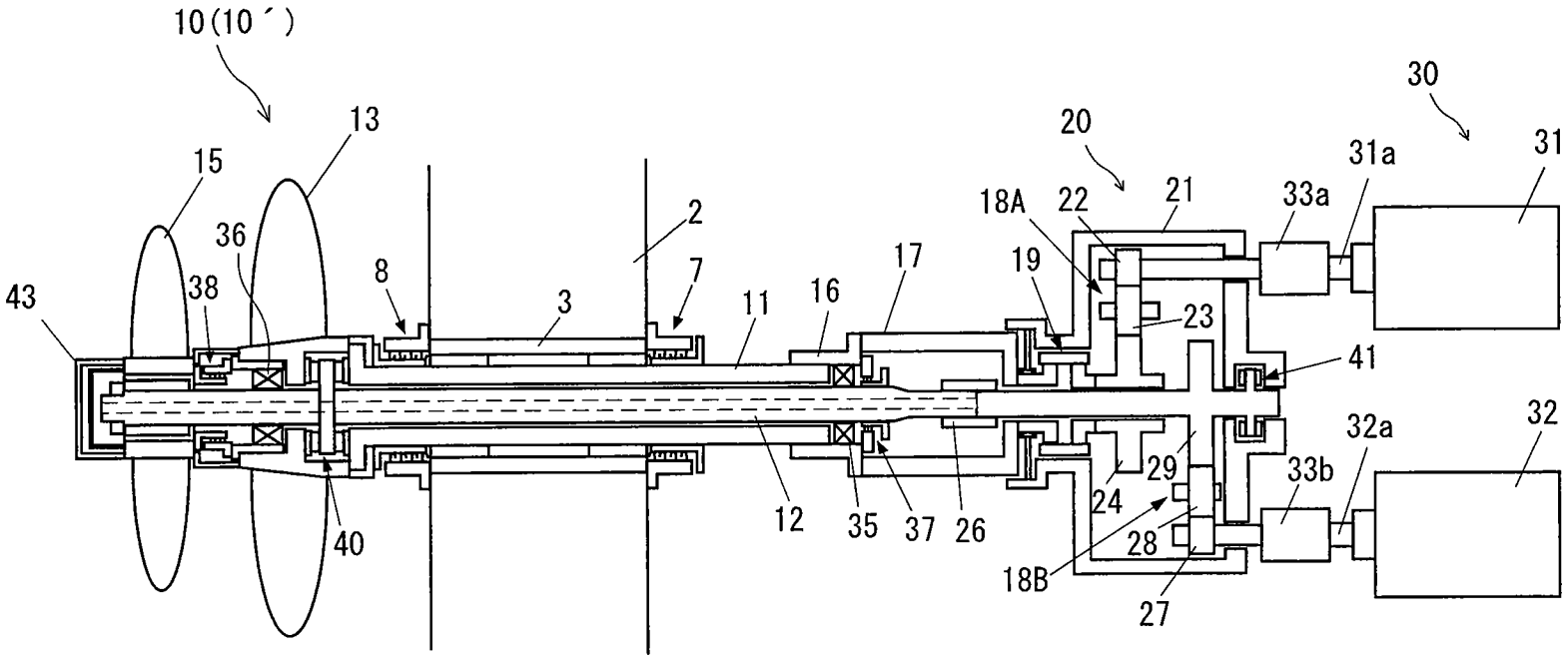
FIG. 10 is a whole schematic view of a contra-rotating propeller propulsion device.

The contra-rotating propeller unit 10 (10') mounted on a mother ship is connected to the driving power side, and is completed as a contra-rotating propeller propulsion device. FIG. 10 is a whole schematic view of the contra-rotating propeller propulsion device.

An outer sleeve joint 16 is connected and fixed to a bow-side end of the outer shaft 11. A hollow outer intermediate shaft 17 is connected and fixed to a bow-side end of the outer sleeve joint 16. In an exemplary construction of FIG. 10, the contra-rotating front bearing 35 is arranged between the outer sleeve joint 16, and the inner shaft 12.

In order prevent lubricant oil from leaking out, the contra-rotating front seal unit 37 is arranged at a bow-side end face of the outer sleeve joint 16. In order to prevent the leakage of lubricant oil in the stern tube inner cylinder 3 towards the engine room, a bow-side end face of the stern tube inner cylinder 3 is provided with the stern tube front seal unit 7. In addition, in the contra-rotating propeller unit 10' of the second embodiment, the stern tube front seal unit 7 is attached after the outer fixing tool 69 is detached.

The driving unit 30 adopted in the exemplary construction of FIG. 10 includes a first driving unit 31 that is the rotational driving power of the outer shaft 11 and a second driving unit 32 that is the rotational driving power of the inner shaft 12. The first driving unit 31 and the second driving unit 32 may be main engines, such as gas-turbine engines and diesel engines, or may be electric motors. In the case of the electric motors, for example, it is possible to mount one or a plurality of gas turbine generators, diesel engine generators, etc. on the engine room, and use this as a power.

A power transmission unit 20 adopted in an exemplary construction of FIG. 10 is a contra-rotating gear transmission unit which is constructed so that the rotational driving forces of the first driving unit 31 and the second driving unit 32 are independently transmitted to the outer shaft 11 and the inner shaft 12, respectively. More specifically, the power transmission unit 20 has a housing 21, and includes an outer transmission mechanism 18A, and an inner transmission mechanism 18B in the housing 21.

In the construction of FIG. 10, both the outer transmission mechanism 18A and the inner transmission mechanism 18B include gear transmission mechanisms.

The outer transmission mechanism 18A has an outer input gear 22 connected to an output shaft 31*a* of the first driving unit 31, a hollow outer main output gear 24, and an outer intermediate small pinion 23 arranged between the outer input gear 22 and the outer main output gear 24. The output shaft 31*a* of the first driving unit 31 and the outer input gear 22 are connected together via a gear coupling 33*a*.

The inner transmission mechanism 18B has an inner input gear 27 connected to an output shaft 32*a* of the second driving unit 32, a hollow inner main output gear 29 which passes through the inner shaft, and an inner intermediate small pinion 28 arranged between the inner input gear 27 and the inner main output gear 29. The output shaft 32*a* of the second driving unit 32 and the inner input gear 27 are connected together via a gear coupling 33*b*. The inner main output gear 29 and the inner shaft 12 are connected and fixed together by an inner sleeve joint 26.

An inner thrust bearing 41 which receives the thrust load (the combined load of the thrust load of only the inner shaft 12 and the thrust load of only the outer shaft 11) from the inner shaft 12 and transmits the thrust load to the ship body 2 is provided at a bow-side portion of the housing 21 of the power transmission unit 20. For this reason, the thrust load from the inner shaft 12 is supported by the ship body 2 via the housing 21.

The outer main output gear 24 and the outer shaft 11 are connected together via a hollow flexible joint 19. In the exemplary construction of FIG. 10, the flexible joint 19 is a gear coupling, the outer main output gear 24 is connected and fixed to the bow side of the gear coupling, and the outer intermediate shaft 17 is connected and fixed to the stern side of the gear coupling.

By the above-described construction, when the first driving unit 31 is rotationally driven, the driving force thereof is transmitted to the outer shaft 11 via the outer transmission mechanism 18A, the flexible joint 19, etc., and the front propeller 13 attached to the outer shaft 11 rotates. Additionally, when the second driving unit 32 is rotationally driven, the driving force thereof is transmitted to the inner shaft 12 via the inner transmission mechanism 18B and the inner sleeve joint 26, and the rear propeller 15 attached to the inner shaft 12 rotates.

At this time, it is possible to make the front propeller 13 and the rear propeller 15 rotate in directions opposite to each other by making the outer shaft 11 and the inner shaft 12 rotate in directions opposite to each other. Although the rotational directions of driving shafts of the first driving unit 31 and the second driving unit 32 for making the front propeller 13 and the rear propeller 15 in directions opposite to each other depend on the construction of the power transmission unit 20, in the case of the exemplary construction of FIG. 8, the front propeller 13 and the rear propeller 15 rotate in directions opposite to each other if the rotational directions of the output shafts of the first driving unit 31 and the second driving unit 32 are opposite to each other.

In addition, although a drive mechanism of a method which outputs the rotation of two shafts with respect to the rotation input of two shafts is adopted as a driving method of the contra-rotating propeller in the exemplary construction shown in FIG. 10, a drive mechanism of a method which outputs the rotation of two shafts which rotate in directions opposite to each other with respect to the rotation input of one shaft.

Additionally, although the exemplary construction shown in FIG. 10 has been the construction in which the outer main output gear 24 and the outer shaft 11 are connected together via the flexible joint 19, a construction in which the outer main output gear 24 and the outer shaft 11 are connected together by a rigid joint may be adopted.

In addition, while the preferred embodiments of the invention have been described above, it should be understood that these are exemplary of the invention and the technical scope of the invention are not limited thereto. The scope of the invention is shown in the description of the appended claims. Additionally, various modifications may be made within the scope and the meaning equivalent to the description of the appended claims.

The invention claimed is:

1. A contra-rotating propeller unit including:

(a) a hollow outer shaft having a front propeller attached to a rear end thereof, and an inner shaft having a rear propeller attached to a rear end thereof and inserted into and supported in the outer shaft;

(b) a predetermined part on a rear side of the inner shaft that is supported by a contra-rotating rear bearing provided in a boss of the front propeller;

(c) an inner fixing tool that is detachably attached to a tip portion of the outer shaft to temporarily support the predetermined part on a front side of the inner shaft; and (d) a contra-rotating thrust bearing provided in the boss of the front propeller to receive a thrust load from the outer shaft to transmit the thrust load to the inner shaft.

2. The contra-rotating propeller unit according to claim 1, wherein the inner fixing tool has a guide body with an external diameter which is equal to or greater than an external diameter of the outer shaft and is smaller than an internal diameter of stern tube bearing parts, and the guide member is made of a material softer than the stern tube bearing part, and has a chamfered portion at the outer peripheral edge of the tip thereof.

3. The contra-rotating propeller unit according to claim 1, further comprising:

(e) an inner lifting tool detachably attached to a tip portion of the inner shaft and having a lifting piece provided at a tip of the tip portion.

4. The contra-rotating propeller unit according to claim 3, wherein the inner shaft is formed in a hollow shape, wherein lubricant oil passages are formed between the hollow portion of the inner shaft, wherein the inner shaft and the outer shaft, a first seal member is provided between the inner fixing tool and the outer shaft, and a second seal member is provided between the inner fixing tool and the inner shaft, wherein the third seal member is provided between the inner lifting tool and the inner shaft, and wherein the inner lifting tool has an introduction oil passage for introducing lubricant oil into the hollow portion of the inner shaft.

5. The contra-rotating propeller unit according to claim 3, wherein the contra-rotating propeller unit has a guide member with an external diameter which is greater than the external diameter of the tip portion of the inner shaft, and is smaller than the outer shaft, and the guide member is made of a material softer than the outer shaft, and has a chamfered portion at the outer peripheral edge of the tip thereof.

6. The contra-rotating propeller unit according to claim 1, wherein the inner fixing tool has a construction that is radially splitable into a plurality of pieces.

7. The contra-rotating propeller unit according to claim 1, further comprising:

(e) a stern tube rear seal unit installed in the predetermined part on the rear side of the outer shaft, and a rear seal fixing tool attached to the outer shaft to temporarily fix the stern tube rear seal unit to the outer shaft.

8. The contra-rotating propeller unit according to claim 7, wherein the rear seal fixing tool has a construction that is radially splittable into a plurality of pieces.

9. The contra-rotating propeller unit according to claim 1, further comprising:

(e) a hollow stern tube inner cylinder that has stern tube bearing parts mounted thereon, has the outer shaft inserted thereinto, and supports the outer shaft;

(f) a stern tube rear seal unit attached to a rear end of the stern tube inner cylinder; and (g) an outer fixing tool that is detachably attached to a tip portion of the stern tube inner cylinder, and temporarily supports the predetermined part on the front side of the outer shaft, and temporarily constrains axial movement of the outer shaft with respect to the stern tube inner cylinder.

10. A method for assembling a contra-rotating propeller unit including a hollow outer shaft having a front propeller attached to a rear end thereof, and an inner shaft having a rear propeller attached to a rear end thereof and inserted into and supported in the outer shaft, wherein the method comprises the steps of:

(a) inserting the inner shaft into the outer shaft;

(b) assembling a contra-rotating thrust bearing for receiving a thrust load from the outer shaft to transmit the thrust load to the inner shaft into a boss of the front propeller, thereby constraining axial movement of the inner shaft with respect to the outer shaft;

(c) installing a contra-rotating rear bearing in the boss of the front propeller, and supporting a predetermined part on a rear side of the inner shaft by the contra-rotating rear bearing; and (d) attaching an inner fixing tool to a tip portion of the outer shaft, and temporarily supporting the predetermined part on a front side of the inner shaft by the inner fixing tool.

11. A method for assembling a contra-rotating propeller unit including a hollow outer shaft having a front propeller attached to a rear end thereof, and an inner shaft having a rear propeller attached to a rear end thereof and inserted into and supported in the outer shaft, wherein the method comprises the steps of:

(a) inserting the outer shaft into a hollow stem tube inner cylinder mounted with stern tube bearing parts;

(b) attaching a stern tube rear seal unit to a rear end of the stern tube inner cylinder;

(c) attaching an outer shaft fixing tool to the stern tube inner cylinder, and temporarily supporting a predetermined part on a front side of the outer shaft by the outer fixing tool, and temporarily constraining axial movement of the outer shaft with respect to the stern tube inner cylinder;

(d) inserting the inner shaft into the outer shaft;

(e) assembling a contra-rotating thrust bearing for receiving the thrust load from the outer shaft to transmit the thrust load to the inner shaft into a boss of the front propeller, thereby constraining axial movement of the inner shaft with respect to the outer shaft;

(d) installing a contra-rotating rear bearing in the boss of the front propeller, and supporting the predetermined part on a rear side of the inner shaft by the contra-rotating rear bearing; and (e) attaching an inner fixing tool to a tip portion of the outer shaft, and temporarily supporting the predetermined part on the front side of the inner shaft by the inner fixing tool.

12. The method for assembling a contra-rotating propeller unit according to claim 10, further comprising attaching an inner lifting tool having a lifting piece provided at the tip thereof, to a tip portion of the inner shaft.

13. The method for assembling a contra-rotating propeller unit according to claim 10, further comprising installing a stern tube rear seal unit in a predetermined part on the rear side of the outer shaft, and attaching a rear seal fixing tool to the outer shaft to temporarily fix the stern tube rear seal unit to the outer shaft.

14. The method for assembling a contra-rotating propeller unit according to claim 10, wherein a contra-rotating propeller unit is assembled on a temporary placing base including an assembly lower base installed in an installation surface, and an upper receiving base detachably attached to the assembly lower base to support the outer shaft, and wherein upper receiving bases with a plurality of kinds of sizes corresponding to the size of the outer shaft are allowed to be attached to the assembly lower base.

15. The method for assembling a contra-rotating propeller unit according to claim 11, wherein a contra-rotating propeller unit is assembled on a temporary placing base including an assembly lower base installed in an installation surface, and an upper receiving base detachably attached to the assembly lower base to support the stern tube inner cylinder, and wherein upper receiving bases with a plurality of kinds of sizes corresponding to the size of the stern tube inner cylinder are allowed to be attached to the assembly lower base.

16. A method for transporting the contra-rotating propeller unit according to claim 1, wherein the contra-rotating propeller unit is assembled on a temporary placing base, and wherein the method comprises the steps of:

(a) placing the contra-rotating propeller unit and the temporary placing base on transportation means, wherein the assembled contra-rotating propeller unit is placed on the temporary placing base; and (b) transporting the contra-rotating propeller unit and the temporary base by the transportation means.

17. The method for transporting the contra-rotating propeller unit according to claim 9, wherein the contra-rotating propeller unit is assembled on a temporary placing base, and wherein the method comprises the steps of:

(a) placing the contra-rotating propeller unit and the temporary placing base on transportation means, wherein the assembled contra-rotating propeller unit is placed on the temporary placing base; and (b) transporting the contra-rotating propeller unit and the temporary base by the transportation means.

18. A method for mounting on a mother ship the contra-rotating propeller unit transported by the method for transporting the contra-rotating propeller unit according to claim 16, wherein the temporary placing base includes an assembly lower base installed in an installation surface, and an upper receiving base detachably attached to the assembly lower base to support the outer shaft, wherein the fixation of the upper receiving base to the assembly lower base is released with the contra-rotating propeller unit supported by the upper receiving base, and the contra-rotating propeller unit is lifted parallel to the axial center of a stern tube by lifting the portion of the contra-rotating propeller unit behind a portion inserted into the stern tube inner cylinder of a mother ship, and the upper receiving base by the lifting means, and wherein the lifted contra-rotating propeller unit is moved forward and inserted into the stern tube.

19. A method for mounting on a mother ship the contra-rotating propeller unit transported by the method for transporting the contra-rotating propeller unit according to claim 17, wherein the temporary placing base includes an assembly lower base installed in an installation surface, and an upper receiving base detachably attached to the assembly lower base to support the outer shaft, wherein the fixation of the upper receiving base to the assembly lower base is released with the contra-rotating propeller unit supported by the upper receiving base, and the contra-rotating propeller unit is lifted parallel to the axial center of a stern tube through hole by lifting the portion of the contra-rotating propeller unit behind the stern tube inner cylinder, and the upper receiving base by the lifting means, and wherein the lifted contra-rotating propeller unit is moved forward and inserted into the stern tube through hole.

20. The contra-rotating propeller unit according to claim 2, further comprising:

(e) an inner lifting tool detachably attached to a tip portion of the inner shaft and having a lifting piece provided at a tip of the tip portion.

* * * * *